United States Patent [19]

Meglino

[11] Patent Number: 4,512,556

[45] Date of Patent: Apr. 23, 1985

[54] SLAT RETAINING MEANS FOR CHAIN LINK FENCES

[76] Inventor: Don A. Meglino, 85 Edwards St., Roslyn Heights, N.Y. 11577

[21] Appl. No.: 577,216

[22] Filed: Feb. 6, 1984

[51] Int. Cl.[3] ..... B21F 27/00

[52] U.S. Cl. ..... 256/34; 256/24

[58] Field of Search ..... 256/34, 24

[56] References Cited

U.S. PATENT DOCUMENTS 79,121 6/1868 Hillis ..... 256/34

3,988,009 10/1976 Mann ..... 256/24

4,085,954 4/1978 Thompson ..... 256/34

FOREIGN PATENT DOCUMENTS 192058 10/1964 Sweden ..... 256/34

*Primary Examiner*—Andrew V. Kundrat

*Attorney, Agent, or Firm*—James P. Malone

[57] ABSTRACT

Slat retaining means for chain link fences of the type made of linking wires. A plurality of parallel slats woven through the wires the parallel slats extending in a first direction. An aperture in each parallel slat and a connecting member inserted through said apertures to lock the parallel slats in position.

4 Claims, 2 Drawing Figures

SLAT RETAINING MEANS FOR CHAIN LINK FENCES

TECHNICAL FIELD

This invention relates to slat retaining means for chain link fences and more particularly to means for retaining the slats in position which are not easily removable.

BACKGROUND ART

Slats are commonly inserted in chain link fences to provide privacy and wind protection. Various means have been provided to retain the slats in position on chain link fences as shown in U.S. Pat. Nos.:

2,760,759; 2,802,645; 3,037,593; 3,069,142 and 4,085,954.

These prior art devices generally have disadvantages in that the slats may fall out of the retaining devices or may be easily removed by vandals.

THE INVENTION

The present invention provides means for retaining the slats in proper position where the retaining means is not easy to remove, for instance, by vandals.

More particularly, the present invention provides means for retaining a plurality of parallel slats woven through the wires of the chain link fence comprising an aperture in each parallel slat and a connecting slat inserted through the aperture to lock the parallel slats in position.

OBJECTS OF THE INVENTION

Accordingly, a principal object of the invention is to provide a new and improved slat retaining means for chain link fences.

Another object of the invention is to provide a new and improved slat retaining means for chain link fences wherein the retaining means is secure and not easy to remove.

Another object of the invention is to provide a new and improved slat retaining means for chain link fences of the type made of linking wires, comprising, a plurality of parallel slats woven through the wires the parallel slats extending in a first direction, an aperture in each parallel slat and a connecting member inserted through said apertures to lock the parallel slats in position.

BRIEF DESCRIPTION OF THE DRAWINGS

These and other objects of the invention will be apparent from the following specification and drainws of which.

BEST MODE OF THE INVENTION

Figure 1:
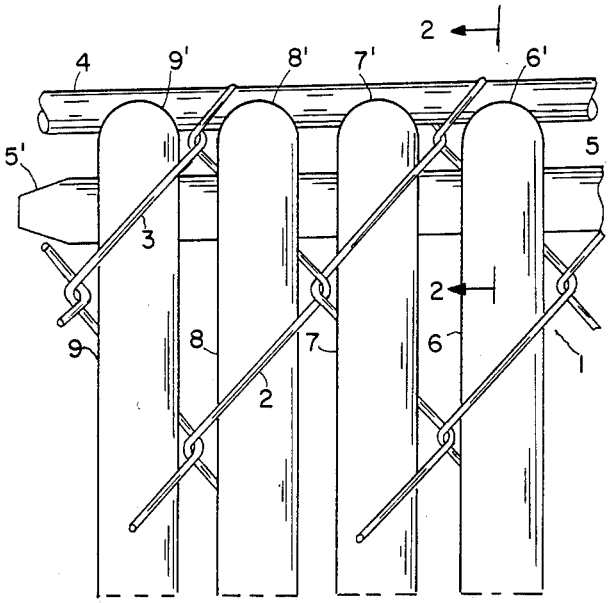
FIG. 1 is a front view of the embodiment of the invention.
Figure 2:
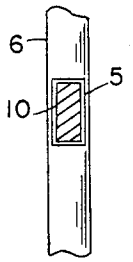
FIG. 2 is a sectional view taken along the line 2—2 of FIG. 1.

Referring to the figures, FIG. 1 shows a typical conventional chain link fence 1, comprised of a plurality of interlocking wires 2 3, etc, the wires being mounted on the supporting bar 4. In order to retain the slats in position a retaining bar or slat 5 is inserted through the parallel slats 6, 7, 8, 9, etc., through apertures 10 in the parallel slats 6, 7, 8, 9. The apertures may be milled or otherwise cut in the parallel slats. The parallel slats may be made of various materials such as plastic, wood or metal, and may be solid or tubular in cross-section.

The leading end 5' of the retaining slat 5 is preferably tapered for easy insertion through the aperture 10 in the parallel slats. The upper ends 6', 7', 8', 9', of the parallel slats may be cut or shaped to simulate picket or other decorative designs.

The retaining member or slat is inserted by passing through the parallel slats. One or both ends of the retaining member or slat may be secured to a vertical fence support with screws, bolts or other conventional means in order to make it difficult or impossible to remove the retaining member.

It is claimed:

1. Slat retaining means for chain link fences of the type made of linking wires comprising:

a plurality of parallel slats woven through the wires the parallel slats extending in a first direction, a rectangular aperture in each parallel slat and a connecting member of complimentary rectangular cross-section along its length inserted through said rectangular apertures to lock the parallel slats in position, wherein the rectangular apertures are a predetermined distance from one end of the parallel slats and the connecting member is adapted to be secured to a vertical fence support.

2. Apparatus as in claim 1 wherein the direction of the connecting member is perpendicular to the direction of the parallel slats.

3. Apparatus as in claim 1 wherein the connecting member is tapered at one end for easy insertion in the parallel slats.

4. Apparatus as in claim 1 wherein the parallel slats are cut at one end to form a decorative pattern.

* * * * *

REEXAMINATION CERTIFICATE (1210th)

United States Patent [19]

Meglino

[11] B1 4,512,556

[45] Certificate Issued Feb. 27, 1990

[54] SLAT RETAINING MEANS FOR CHAIN LINK FENCES

[76] Inventor: Don A. Meglino, 85 Edwards St., Roslyn Heights, N.Y. 11577

Reexamination Request:
No. 90/001,735, Mar. 28, 1989

Reexamination Certificate for:

| | |
|---|---|
| Patent No.: | **4,512,556** |
| Issued: | **Apr. 23, 1985** |
| Appl. No.: | **577,216** |
| Filed: | **Feb. 6, 1984** |

[51] Int. Cl.[4] ..... B21F 27/00
[52] U.S. Cl. ..... 256/34; 256/24
[58] Field of Search ..... 256/34, 24

[56] References Cited

U.S. PATENT DOCUMENTS

| | | | |
|---|---|---|---|
| 79,121 | 6/1868 | Hillis | 256/34 |
| 303,126 | 8/1884 | Cordtz | 256/65 |
| 3,988,009 | 10/1976 | Mann | 256/24 |
| 4,085,954 | 4/1978 | Thompson | 256/34 |

FOREIGN PATENT DOCUMENTS

| | | | |
|---|---|---|---|
| 192058 | 10/1964 | Sweden | 256/34 |

*Primary Examiner*—Andrew Kundrat

[57] ABSTRACT

Slat retaining means for chain link fences of the type made of linking wires. A plurality of parallel slats woven through the wires the parallel slats extending in a first direction. An aperture in each parallel slat and a connecting member inserted through said apertures to lock the parallel slats in position.

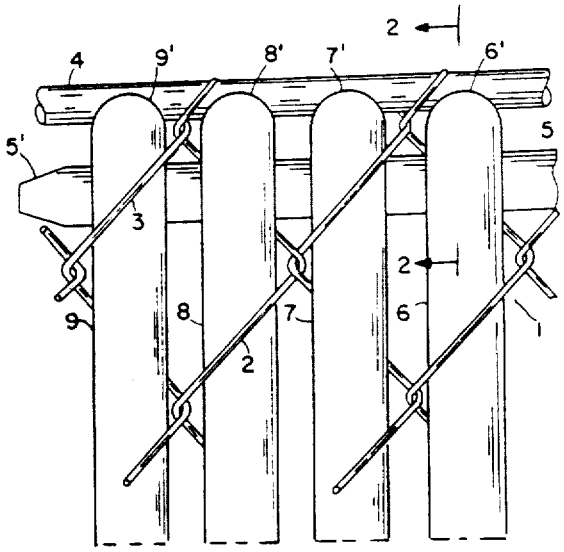

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–4 is confirmed.

New claim 5 is added and determined to be patentable.

*5. Slat retaining means for chain link fences of the type made of linking wires comprising:*

*a plurality of parallel tubular plastic slats woven through the wires the parallel slats extending in a first direction;*

*a rectangular aperture in each parallel slat and*

*a connecting member of complementary rectangular cross-section along its length inserted through said rectangular apertures to lock the parallel slats in position,*

*wherein the rectangular apertures are a predetermined distance from one end of the parallel slats and the connecting member is adapted to be secured to a vertical fence support.*

* * * * *